US006014769A

United States Patent [19]

Baudou et al.

[11] Patent Number: 6,014,769

[45] Date of Patent: Jan. 18, 2000

[54] HELMET COMPRISING A PART THAT IS JETTISONABLE BY MEANS OF AN INFLATABLE CUSHION

[75] Inventors: Joël Baudou, St Medard En Jalles; Alain Leger, Merignac, both of France

[73] Assignee: Sextant Avionique, Velizy Villacoublay, France

[21] Appl. No.: 09/209,478

[22] Filed: Dec. 11, 1998

[30] Foreign Application Priority Data

Dec. 12, 1997 [FR] France ..... 97 15777

[51] Int. Cl.[7] ..... A42B 3/00

[52] U.S. Cl. ..... 2/6.1; 2/413; 2/424

[58] Field of Search ..... 2/410, 6.1, 6.2, 2/6.3, 411, 413, 422, 424

[56] References Cited

U.S. PATENT DOCUMENTS

| | | | |
|---|---|---|---|
| 3,645,259 | 2/1972 | Schulman | 2/6.1 |
| 4,803,980 | 2/1989 | Nowakowski et al. . | |
| 5,176,342 | 1/1993 | Schmidt et al. . | |
| 5,467,480 | 11/1995 | Baudou et al. . | |
| 5,534,689 | 7/1996 | Barbier et al. . | |
| 5,566,398 | 10/1996 | Deagan | 2/413 |
| 5,623,730 | 4/1997 | Baudou et al. . | |
| 5,675,328 | 10/1997 | Coirier et al. . | |
| 5,742,937 | 4/1998 | Baudou et al. . | |

FOREIGN PATENT DOCUMENTS

| | | |
|---|---|---|
| 1 944 821 | 3/1971 | Germany . |
| 93 13 501 | 1/1994 | Germany . |
| 196 04 822 | 8/1997 | Germany . |
| 2 179 543 | 3/1987 | United Kingdom . |

*Primary Examiner*—Michael A. Neas
*Attorney, Agent, or Firm*—Oblon, Spivak, McClelland, Maier & Neustadt, P.C.

[57] ABSTRACT

In order to protect the neck of the wearer of a helmet comprising heavy and/or dangerous equipment, the helmet comprises a part that can be jettisoned in the event of an emergency. The jettisonable part is separated from the fixed part of the helmet by the rapid inflation of a cushion between these two parts. The device can be applied especially to helmets worn by the pilots of armed helicopters or aircraft.

10 Claims, 2 Drawing Sheets

HELMET COMPRISING A PART THAT IS JETTISONABLE BY MEANS OF AN INFLATABLE CUSHION

BACKGROUND OF THE INVENTION

1. Field of the Invention

The present invention relates to the protection of the head and neck of an individual carrying heavy or dangerous equipment on his or her head. It can be applied especially to a helmet such as that of a pilot of an armed helicopter or aircraft where certain forms of equipment may aggravate the risks of injury to the wearer under particular conditions of use of the helmet.

A helmet such as that of the pilot of an armed helicopter does not only protect the head that it covers. It is a multi-functional device. It enables the mechanical protection of the skull as well as the protection of the ears, eyes and face. It also enables communication by auditory channels, assistance in viewing the environment and, if necessary, it supplies oxygen to the pilot. These functions are fulfilled by various types of equipment.

A helmet of this kind has a rigid body or shell that generally surrounds the peak, rear and side parts of the wearer's skull. The shell protects the skull from perforation. For modern helmets, it is often made of a highly resistant composite material.

The helmet also has an inner cap located between the rigid shell and the skull which is covered by the helmet. The cap is made of an absorbent material and protects the head by absorbing a part of the shocks received by the external face of the shell. Most usually, it is fixedly joined to the shell.

A system of auditory protection may be integrated into the internal cap, at the level of the wearer's ears.

The helmet may include a visor through which the helmet wearer can see his or her environment. The visor is usually retractable towards the peak of the skull. It forms a protective screen for the face when it is in the lowered position. The visor can also be provided with optical treatment on its surface for the optical protection of the wearer's eyes.

The function of sound communication can be obtained by a microphone placed in the vicinity of the mouth and earphones fixed close to the ears on the internal face of the cap.

Furthermore, the helmet commonly has equipment that provides display assistance. This equipment complements and/or replaces the direct view of the environment of the helmet wearer by means of visual information. The display assistance may include a system for superimposing a reticule, symbols or an image on the direct view in order, for example, to facilitate piloting, navigation or the designation of an object to be reached. The display assistance may also include a night vision device with sensors other than the human eye such as for example light intensifiers or infrared image sensors whose signals are processed to reconstruct an image of the night scene. The image is presented to the wearer's eyes. It provides night vision by complementing the direct view of the eye and/or by replacing it.

The visual information to be presented is for example displayed on a screen integrated into the helmet such as a cathode-ray tube screen or a liquid crystal screen. Optical devices also integrated into the helmet enable the presenting of information before the wearer's eyes. These devices generally comprise collimation means so that the wearer of the helmet can perceive visual information in the plane of the scene. The means used to present visual information to the wearer of the helmet constitute a helmet display device. The dimensions of the optical units integrated into the display device are reduced but their weight remains substantial.

The total mass of the multifunctional helmet fitted out with a display device becomes very great. It often exceeds half the mass of the bare head. And the distribution, in the helmet, of the weighty elements needed for all these functions and especially for display assistance is the result of a compromise made in order to meet various constraints. This display most often adds further weight to the upper part of the helmet and especially the part protecting the wearer's forehead.

Another relatively simple piece of equipment for night vision assistance consists in placing a night vision field glass before the eye. This field glass comprises a image-taking objective and a light intensifier. Thus, the eye sees an intensified image of the scene in the field glass. To free the observer's hands, the night vision field glass may be mounted on the helmet. It is generally fixedly joined to an arm that is attached to the helmet on the wearer's forehead. This position gives rises to added weight on the helmet towards the top and towards the front.

The center of gravity of the covered head fitted with a display assistance device is further away from the axis of rotation of the neck than the natural center of gravity of the bare head, because the helmet has an elongated lever arm.

And when the head thus covered undergoes high acceleration, for example when the helicopter being piloted by the helmet wearer crashes, the helmet fitted out with the night vision device exerts a moment on the pilot's neck. This moment is proportional to its total mass and to the square of the elongated lever arm. It is greater than the moment that would be exerted in the same example on the bare head.

Thus the neck, which can withstand a given acceleration on the bare head without harm, suffers serious injury when the same acceleration is applied to the weighed-down covered head for which the position of the center of gravity entails greater penalties.

2. Description of the Prior Art

To ensure the safety of the helmet wearer, one standard for helmets recommends a link between the helmet and a weighty element fixed to the helmet complying with the following characteristics: the link permits the ejection of the weighty element in the event of an emergency when the helmet is subjected to a longitudinal acceleration (i.e. along an axis perpendicular to the wearer's face) the value of this acceleration ranging from 100 $m/s^2$ to 150 $m/s^2$. The prior art teaches us the use of a link formed by a retractable bolt using a spring that gets compressed when the acceleration goes beyond a threshold. When the helmet at rest undergoes no acceleration, the initial tension of the spring takes account of the mass to be ejected and the acceleration threshold desired to activate the ejection.

The ejection lightens the covered head by the jettisoned mass. It thus reduces the force of inertia of the covered head and the moment of this force applied to the joint of the neck. The ejection provides for a protection of the neck. However, this protection taught by the prior art is insufficient.

First of all, the protection during a frontal shock is efficient only if the shock undergone by the helicopter is sufficiently strong. In the event of a weaker frontal shock, the link is maintained, the mass is not ejected and the neck may be damaged by a shear stress.

Furthermore, the ejection is not ensured when the shock is not frontal, for example if the helicopter crashes vertically during stationary flight or again in the event of a lateral crash due to the gyroscopic torque of the rotor of the helicopter.

Furthermore, in the case of a weighty piece of equipment installed beneath the visor, the protection of the neck is provided by the ejection of the assembly comprising the weighty equipment and the visor but the ejection of this assembly deprives the wearer's face of the mechanical protection provided by the visor and often reduces the protection of the forehead. This protection of the neck leads to a reduction in the protection, against impacts, of a part of the head. It increases the risk of injuries to the head during an accident.

The problem lies in making a helmet that provides better protection for its wearer's head and neck especially in the case of emergency when one or more elements of the helmet become an immediate danger to the wearer of the helmet.

SUMMARY OF THE INVENTION

This is why the invention proposes a helmet comprising a part that is jettisonable in an emergency, comprising, firstly, an inflatable cushion inserted between a shell of the helmet and the jettisonable part and, secondly, means to rapidly inflate the cushion so as to separate the jettisonable part from the shell.

When the cushion is not inflated, its envelope is located between the shell of the helmet and the jettisonable part and the amount of space that it takes up is limited. The helmet according to the invention has a source of expandable gas whose expansion enables the inflation of the envelope of the cushion. The inflation is obtained for example by the expansion of a compressed gas or of the gases produced by combustion.

The link between the jettisonable part and the shell of the helmet can be retracted or torn away. The inflation of the cushion exerts a stress on this link. Sufficient stress enables the releasing of the link.

The jettisoning is ensured in any position of the head of the helmet wearer.

The jettisoning can be obtained in various situations, for example in an emergency corresponding to a shock to the vehicle of the wearer or to the reception of an alarm signal. The alarm may be given upon the detection or prediction of an imminent danger. The danger is most often due to the mass of the jettisonable part and its effects in the event of shock, for example effects such as injuries to the wearer's head and/or neck. However this danger is also related to other features of the jettisonable part such as, for example, inflammability in a very hot environment.

A rapid inflation of the cushion leads to the ejection of the jettisonable part.

The release of the compressed gas or the beginning of combustion may be initiated by mechanical or electrical means.

When the emergency situation corresponds to the application of an acceleration which the helmet wearer's neck cannot withstand without damage, the jettisoning may be activated by this acceleration.

The jettisoning may be activated by a shock detector.

In one alternative embodiment of the invention, the compressed gas is kept in a container, which may or may not be helmet-mounted, by means of a closing device that opens when the acceleration goes beyond a certain value.

In another variant, the crossing of a threshold by the controlled acceleration activates a mechanical or electrical trigger (a striking pin) to initiate the combustion of a pyrotechnic fuel.

The measurement of the acceleration enables the detection of a dangerous acceleration. This detection activates the inflation.

When the helmet is subjected to an acceleration, forces of inertia are exerted on the various elements of the helmet. The application of a force of inertia mechanically activates an element that is sensitive to this force. A spring with a stiffness that is programmed for a value of a force of inertia may activate the triggering of the inflation when the acceleration undergone is dangerous.

In one embodiment, the device for closing the container of compressed gas container comprises a spring with programmed stiffness.

In another embodiment, a inertial mechanical striking pin is activated by the force that the acceleration exerts on it.

The jettisoning may be activated by an electronic computer with which the inflating means communicate and which may be at a distance from the helmet. The computer takes account of the risk incurred and/or the piloting and navigation parameters of a vehicle.

BRIEF DESCRIPTION OF THE DRAWINGS

Other characteristics and advantages of the invention shall appear from the following detailed description made with reference to the appended drawings, in which one and the same reference corresponds to the depiction of one and the same element.

MORE DETAILED DESCRIPTION

Figure 1:
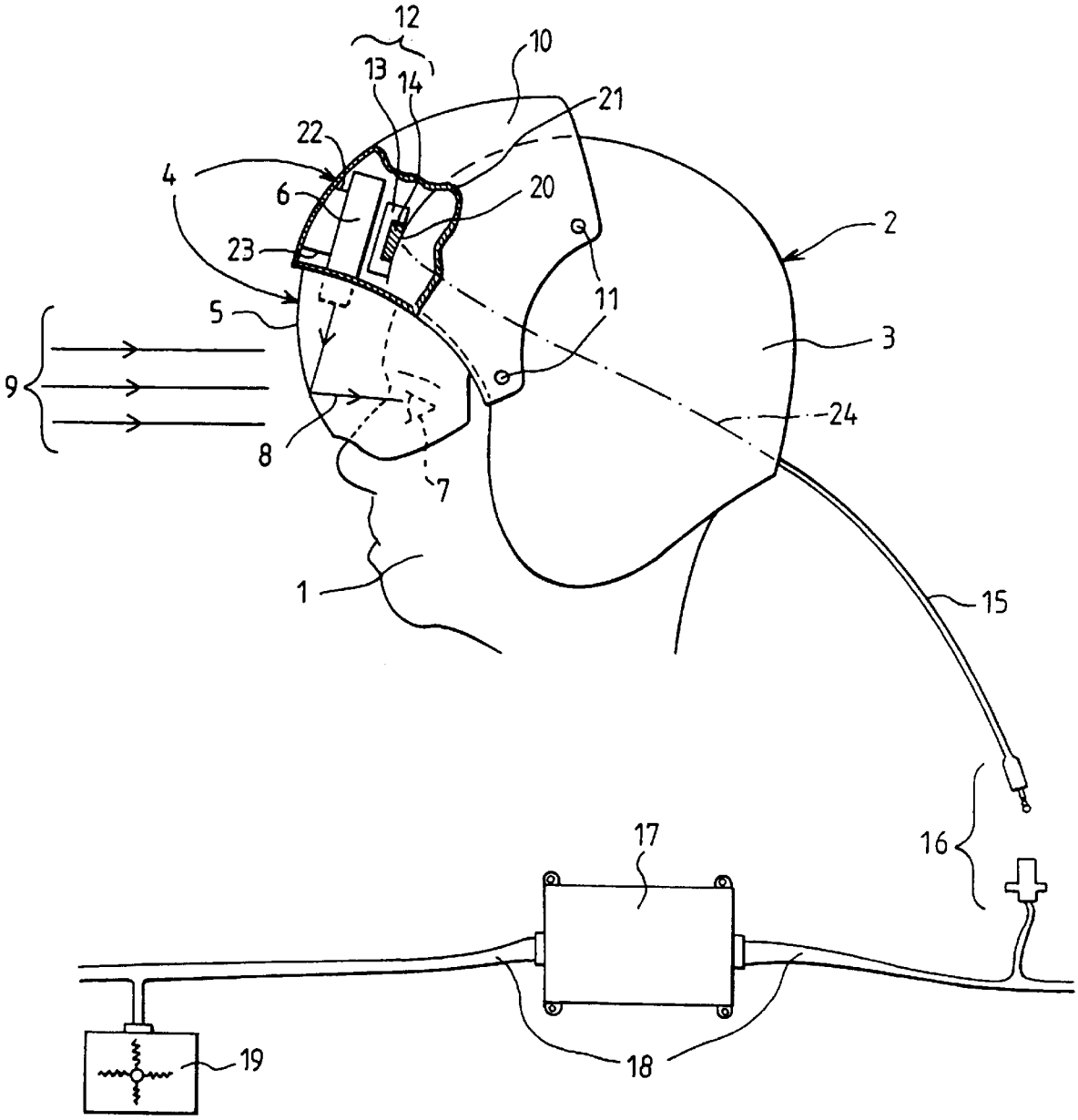
FIG. 1 shows a helmet, according to the invention, comprising a display device.

In FIG. 1, the head of a helicopter pilot 1 is covered with a helmet 2. The shell 3 of the helmet covers the pilot's skull cap and ears and the helmet 2 is fitted out with a display device placed before the pilot's eyes and forehead.

The display device comprises a visor 5 on which an optical imaging device 6 projects an image which is reflected towards the pilot's eye 7 by the semi-transparent visor. The image can also be collimated by the visor. The eye 7 receives light rays 8 coming from the imaging device and simultaneously receives light rays 9 coming from its environment. The pilot then perceives visual information from the imaging device 6 superimposed on his or her view of the scene.

The helmet 2 also has a part 10 for the protection of the imaging device 6. In FIG. 1, this part 10 is only partially shown and the missing part, which corresponds to the surface demarcated by the curved contour 21 shown in bold lines, makes it possible to facilitate the depiction of elements of the helmet located beneath the part 10. In the embodiment illustrated by FIG. 1, the imaging device 6 is attached to the part 10 by fastening means 22, 23. In this same embodiment, the part 10 is fixedly joined to the visor 5 and is fastened to the shell 3 by means of fastening elements 11. The fastening elements 11 may be released so as to achieve the separation, from the shell 3, of an assembly of elements of the helmet comprising, for example, the visor 5, the part 10 and the imaging device 6. This assembly forms a jettisonable part 4 of the helmet 2.

The fastening elements 11 form a link between the shell 3 and the jettisonable part 4. The link is retractable or capable of being torn away, especially in an emergency. This type of link is in accordance with the standard MIL.A-49425 (pertaining to Automatic Breakaway).

The helmet 2 is fitted out with a jettisoning device 12 placed between the shell 3 and the jettisonable part 4. The jettisoning device 12 comprises an inflatable cushion 13 that is shown in a non-inflated state in FIG. 1 and means used to inflate it.

The inflatable cushion 13 comprises an envelope that has low space requirement when it is not inflated. The envelope may be folded or extensible. The helmet has a source of expandable gas. The inflation of the envelope is prompted by the fast expansion in it of the gas coming from the source. The gas source is for example compressed gas contained in a tank or container which may or may not be helmet-mounted. It may be formed by gases produced by a fuel. When the gas source is at a distance from the envelope, a means for the conveyance of the gas carries the gas from the container to the envelope. In the embodiment shown in FIG. 1, the gas used to fill the envelope is the result of combustion.

In getting inflated, the volume of the cushion increases and the cushion takes support on the parts of the helmet that neighbor it. In the embodiment shown in FIG. 1, when the cushion gets inflated, it rests both on a front part 20 of the shell 3 and on the imaging device 6 of the jettisonable part 4 and it exerts a stress thereon, for example proportional to its inflation. It then indirectly exerts a force on the fastening elements 11. During inflation, this force becomes sufficient to release, for example by retraction or rupture, the link between the jettisonable part 4 and the shell 3.

The fastening elements 11 can be retracted and in this case the jettisonable part 4 gets detached or unhooked or comes out of the shell 3.

The fastening elements may equally well be made out of a plastic or flexible material. The fastening elements can then be torn away (by a break programmed for a specified stress) and the force exerted by the inflation of the cushion deforms them until the release of the jettisonable part. A tearaway link has mechanical resistance limited to a certain stress and the application of a greater stress modifies the link. This link then yields. By continuing its inflation, the volume of the cushion increases and causes the jettisonable part to move further away, for towards the front of the pilot's head, and this jettisonable part then falls.

In the embodiment of the invention illustrated by FIG. 1, the cushion is fixedly joined to the front part 20 of the shell 3 whether it is inflated or not. And the expansion of the inflating gas takes place in the front part 20. The inflated cushion remains fixed to the front part 20 of the shell 3. It fills a part of the unoccupied space when the jettisonable part is absent. In this state, the pilot's face and forehead are no longer protected by the visor but the inflation of the cushion provides a substitute protection of the forehead by the absorbing of the shocks received on the cushion.

An alternative embodiment consists of the use of an inflatable cushion that is fixedly joined to the part of the helmet that can be jettisoned. The effect of the jettisoning of a dangerous part of the helmet by means of the inflation of the cushion is not modified by an arrangement of this kind.

In the embodiment shown in FIG. 1, the means used for inflation comprise a pyrotechnic cartridge 14 and means to activate the triggering of this cartridge. The cartridge 14 is inserted between the shell and the jettisonable part of the helmet. The cartridge 14 is electrically connected to an accelerometer 19 by a wire 24 of a plug cord 15 connecting the helmet to the helicopter, a connection means 16, an electronic pack 17 and a communications bus 18 internal to the helicopter. In FIG. 1, the wire 24 of the cord 15 is shown in dashes along its passage beneath the external face of the shell 3.

The accelerometer 19 provides a measurement of the acceleration undergone by the helicopter in the form of an electrical signal sent on the bus 18. The signal is conveyed by the bus up to the electronic pack 17. The pack 17 controls the firing or activation of the cartridge 14 for example when it detects a signal above a triggering threshold corresponding to an acceleration with an intensity greater than normal. The threshold defines the case of emergency. It is selected, for example before departure on a mission, as a function of the resistance of the pilot's neck and the mass of the helmet fitted out with the display device. The pack 17 then sends an electrical control signal on the bus 18 to activate the inflation of the cushion. This signal is sent to the cord 15 when it is connected to the bus 18. It can be seen that, in FIG. 1, the cord 15 is shown as being disconnected from the bus 18 at the connection means 16. The inflation control signal is fed to an electrical pin striker which initiates the combustion of a fuel, which is for example a solid propergol, contained in the pyrotechnic cartridge 14. The combustion that is initiated gets propagated instantly and releases a large quantity of gas whose expansion in the envelope of the cushion inflates it. The envelope is preferably kept tightly sealed with respect to the cartridge 14.

The increase in the volume of the cushion is obtained in a very short period of time. The jettisonable part 4 is ejected from the shell 3.

The releasing of the part 4 is ensured whatever the position of the wearer's head.

Figure 2:
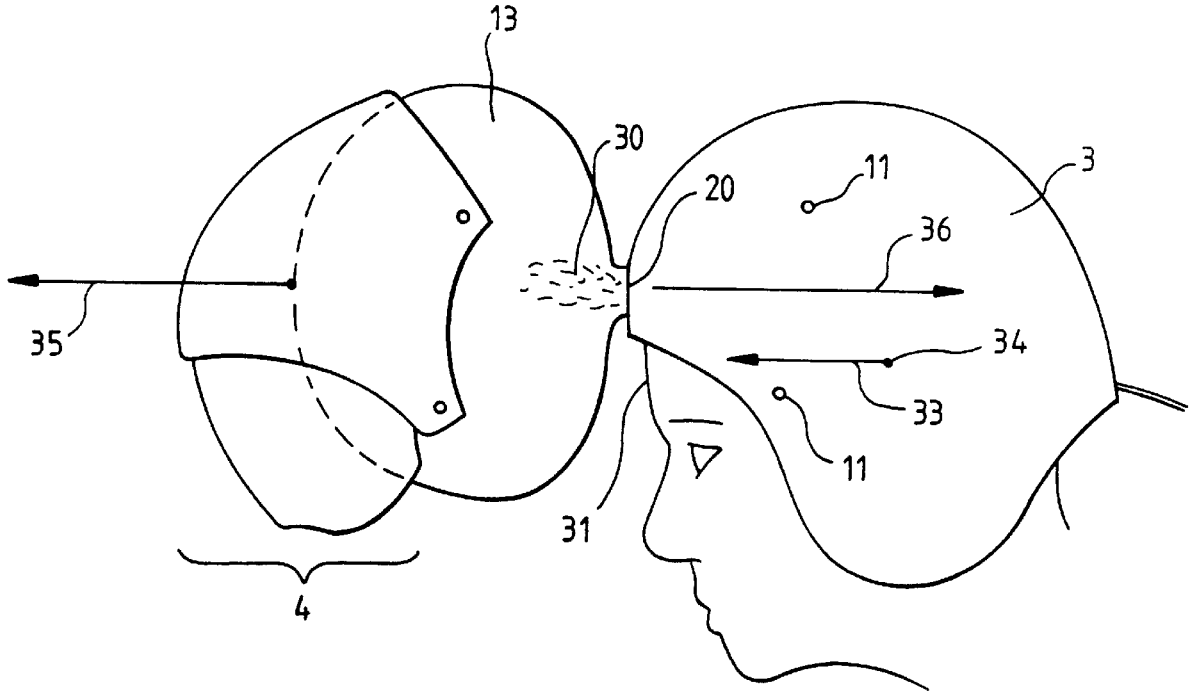
FIG. 2 gives a view, according to the invention, of the separation between the jettisonable part and the shell.

FIG. 2 shows a helmet according to the invention when the envelope of the cushion 13 is getting inflated.

The jettisonable part 4, of which this figure shows the visor 5 and the part 10 for the protection of the display device of the helmet, is being ejected. It is pushed towards the front from the forehead 31 of the helmet wearer by the expansion of the combustion gases 30.

The envelope of the cushion 13 is fixed to the front part 20 of the shell 3 of the helmet by the pyrotechnic cartridge whose volume can no longer be seen in FIG. 2. In this figure, the fuel is almost totally consumed.

The protection of the forehead by the jettisonable part 4 is no longer ensured but the cushion 13, which partly occupies the space cleared by the ejection, provides substitute protection for the helmet wearer's forehead 31 in absorbing the shock of the impact with an obstacle. This protection is valuable during the crashing of a helicopter in which obstacles struck by the head are a major source of injury.

When the helicopter crashes frontally, it is subjected for example to an acceleration 32 represented in FIG. 2 by a horizontal arrow pointing towards the right-hand part of the figure. The pilot's head is oriented towards the front of the vehicle. A force of inertia 33 represented by a horizontal arrow directed towards the left-hand side of FIG. 2 is applied to its center of gravity 34. This force is in the direction opposite that of the acceleration 32. While the jettisonable part 4 of the helmet is being ejected, it is subjected to an ejection stress 35 from the cushion 13 which gets inflated with gas 30. During the jettisoning, the cushion 13 is in contact with the front part 20 of the helmet. It exerts a reaction 36 towards the rear of the helmet, which is for example perpendicular to the surface of the front part 20.

The effect of this reaction is to attenuate the force of inertia applied to the head. This effect is similar to the recoil of a firearm caused by the high-speed ejection of a projectile of low mass.

Figure 3:
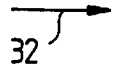
FIG. 3 shows a helmet according to the invention comprising a night vision field glass.
Figure 3:
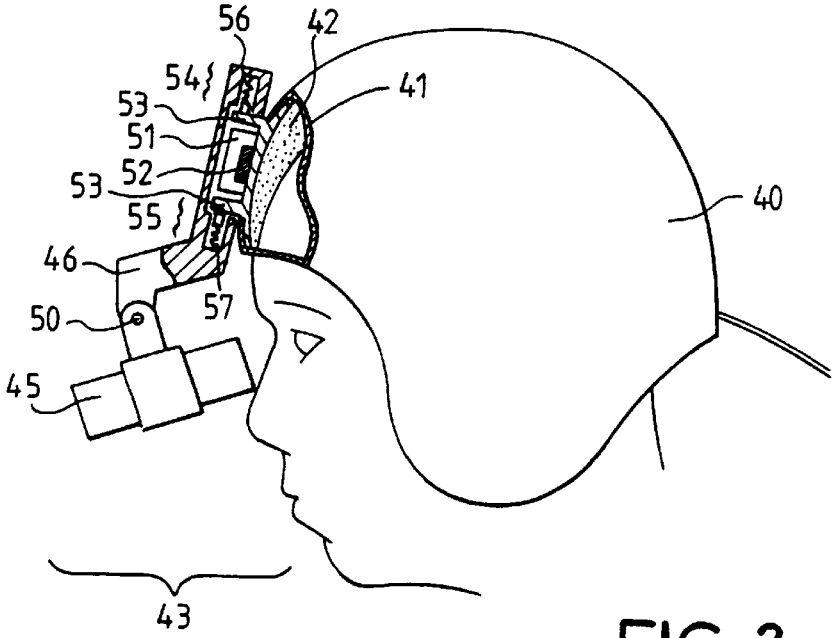

Another embodiment of the helmet according to the invention is illustrated in FIG. 3 where the shell 40 of a helmet is shown incompletely: a part of the shell demarcated by the contour 41, which is represented in FIG. 3 by a thick curved line, is not drawn, leaving visible the internal elements of the helmet. This figure thus shows a partial view of a flexible internal cap 42 which clads the internal part of the rigid shell 40 and matches the shape of the head of the wearer of this helmet. This helmet is also fitted out with a display device 43 fixed to the front part of the helmet by fixing means and placed before the wearer's eye when it is used. The device has a night vision field glass 45 mounted on an arm 46. The field glass 45 includes an objective, an electronic device for the intensification of the nocturnal light received by the objective, a screen to display the intensified image obtained and a hinge 50 providing a link with the arm 46. The hinge 50 makes it possible to place the field glass 45 before the eye or raise it above eye level when the wearer is not using it. The fastening means are integrated into the arm 46. The assembly formed by the field glass 45 and the arm 46 form a jettisonable part of the helmet.

The helmet is shown partially in a sectional view in FIG. 3, at the level of the means for fastening the jettisonable part to the shell.

An inflatable cushion 51 is inserted between the jettisonable part and the shell 40 of the helmet. The cushion is shown in a sectional view in FIG. 3. This figure also shows, beside the cushion 51, a pyrotechnic cartridge 52 for the inflation of the cushion 51. In this example, the cartridge 52 is fixed to the shell 40 of the helmet.

To fasten the jettisonable part, the external surface of the shell 40 has a protruding feature 53 housed in a cavity of the arm 46. The protruding feature itself has a cavity containing the non-inflated cushion 51 and the cartridge 52.

In the embodiment shown in FIG. 3, the jettisonable part is fixed by two retractable bolts 54, 55 each comprising, for example, a precharged spring 56, 57. These bolts create a link between the jettisonable part and the shell. The link is retractable under the pressure exerted by the inflation of the cushion already described with reference to FIG. 1. During its inflation, the cushion 51 increases in volume. It presses both on a part of the cavity of the arm and on the shell 40, at the cavity of the protruding feature of the shell in which there is a means for inflating the envelope of the cushion 51. It exerts pressure on the arm 46 and the stress activates the opening of the retractable bolts. The display device is then jettisoned.

In another embodiment of the invention which is not shown, the command to inflate the ejection cushion is emitted by an electronic computer placed for example on board the vehicle of the helmet wearer. This control is prepared by means of information elements coming for example from the onboard sensors of the vehicle. The electronic computer takes account of the parameters used for the piloting and navigation of the vehicle. For example if the speed on the ground is excessive, the jettisoning is activated just before impact, thus reducing the risks of injury to the neck before the appearance of the limit load factor. The command is preferably sent in the form of an electrical signal that travels up to the pyrotechnic cartridge through the plug cord contained in the helmet.

In the prior art, the jettisonable part is held to the shell of the helmet by a tearaway link, and this link is released under the effect of a force of inertia exerted on the mass of the jettisonable part which is subjected to an acceleration greater than the maximum acceleration that the helmet wearer can withstand without injury.

In the invention, the stress that the inflation of the cushion creates on the jettisonable part is preferably greater than the force of inertia applied to this jettisonable part by the maximum acceleration that can be withstood. The tearaway link of the jettisonable part and of the shell is released only under the stress from the cushion. It is harder than the prior art link. It prevents any involuntary activation in flight, for example through shocks to the helmet, and it is more rigid thus preventing untimely movements of the display device installed on the helmet, during the application of high load factors.

What is claimed is:

1. A helmet comprising a part that is jettisonable in an emergency, comprising, firstly, an inflatable cushion inserted between a shell of the helmet and the jettisonable part and, secondly, means to rapidly inflate the cushion so as to separate the jettisonable part from the shell.

2. A helmet according to claim 1, wherein the inflatable cushion is placed at a place in the helmet such that, in the inflated position, it provides frontal protection to the pilot's head.

3. A helmet according to claim 1, wherein the jettisonable part is a part of the helmet whose weight and position are a source of injury for the head and neck of the wearer in the event of acceleration.

4. A helmet according to claim 1, wherein the inflating means are activated by a shock detector.

5. A helmet according to claim 1, wherein the jettisonable part is a display assistance device mounted on the helmet.

6. A helmet according to claim 1, communicating with an electronic computer, taking account of at least one of the risk incurred and the parameters of the piloting and navigation of a vehicle, to activate the means for inflating the cushion.

7. A helmet according to claim 1, wherein the means to inflate the cushion comprise a pyrotechnic fuel.

8. A helmet according to claim 1, wherein the means to inflate the cushion comprise a pyrotechnic cartridge located between the jettisonable part and the shell of the helmet.

9. A helmet according to claim 1, wherein the jettisonable part is fixed to the shell of the helmet by at least one bolt that is retractable by means of the inflation of the cushion.

10. A helmet according to claim 1, wherein the jettisonable part is fixed to the shell by a link that can be torn away by the inflation of the cushion.

* * * * *